US010668313B2

(12) United States Patent
Hsu

(10) Patent No.: US 10,668,313 B2
(45) Date of Patent: Jun. 2, 2020

(54) NON-MOTORIZED TREADMILL HAVING COMPOSITE RESISTANCE MODULE

(71) Applicant: GREAT FITNESS INDUSTRIAL CO., LTD., Tainan (TW)

(72) Inventor: Chih-Yung Hsu, Tainan (TW)

(73) Assignee: GREAT FITNESS INDUSTRIAL CO., LTD., Tainan (TW)

( * ) Notice: Subject to any disclaimer, the term of this patent is extended or adjusted under 35 U.S.C. 154(b) by 112 days.

(21) Appl. No.: 15/871,235

(22) Filed: Jan. 15, 2018

(65) Prior Publication Data

US 2019/0217142 A1 Jul. 18, 2019

(51) Int. Cl.

| | |
|---|---|
| ***A63B 21/00*** | (2006.01) |
| ***A63B 21/005*** | (2006.01) |
| ***A63B 22/02*** | (2006.01) |
| ***A63B 21/008*** | (2006.01) |
| ***A63B 21/22*** | (2006.01) |

(52) U.S. Cl.

CPC .... *A63B 21/00069* (2013.01); *A63B 21/0051* (2013.01); *A63B 21/0088* (2013.01); *A63B 22/02* (2013.01); *A63B 21/225* (2013.01)

(58) Field of Classification Search

CPC ..... A63B 21/00069; A63B 21/0051; A63B 21/225; A63B 22/02–0228; A63B 2071/0081

USPC ..... 482/114–115, 118, 119; 188/74–76

See application file for complete search history.

(56) References Cited

U.S. PATENT DOCUMENTS

| | | | | |
|---|---|---|---|---|
| 8,585,561 | B2 * | 11/2013 | Watt | A63B 21/0051 482/57 |
| 9,005,085 | B2 | 4/2015 | Astilean | |
| 9,233,272 | B2 | 1/2016 | Villani et al. | |
| 9,814,930 | B2 * | 11/2017 | Manzke | A63B 22/02 |
| 9,987,516 | B1 * | 6/2018 | Chen | A63B 22/0285 |
| 2006/0021830 | A1 * | 2/2006 | Lassanske | A63B 21/153 188/2 D |
| 2008/0096725 | A1 * | 4/2008 | Keiser | A63B 21/0051 482/8 |
| 2012/0088638 | A1 * | 4/2012 | Lull | A63B 21/015 482/57 |
| 2016/0298654 | A1 * | 10/2016 | Wang | F04D 17/16 |
| 2016/0310785 | A1 * | 10/2016 | Lo | A63B 21/005 |
| 2017/0036053 | A1 * | 2/2017 | Smith | A63B 21/0051 |

FOREIGN PATENT DOCUMENTS

TW M530161 U 10/2016

* cited by examiner

*Primary Examiner* — Loan B Jimenez
*Assistant Examiner* — Kathleen Vermillera
(74) *Attorney, Agent, or Firm* — Rosenberg, Klein & Lee

(57) ABSTRACT

A non-motorized treadmill includes a non-motorized treadmill body and a composite resistance module. The non-motorized treadmill body includes two rollers and a treadmill belt. The treadmill belt is wound around the two rollers. The composite resistance module includes a reluctance module and a fan wheel. The reluctance module includes a wheel body and a resistance member. The wheel body is mounted to one of the rollers. The resistance member is located close to the wheel body. One of the wheel body and the resistance member includes a metal member. The other of the wheel body and the resistance member includes a magnetic member. The fan wheel is connected to one side of the wheel body so that one of the rollers is subjected to magnetic resistance and wind resistance when rotated.

7 Claims, 10 Drawing Sheets

NON-MOTORIZED TREADMILL HAVING COMPOSITE RESISTANCE MODULE

FIELD OF THE INVENTION

The present invention relates to a non-motorized treadmill, and more particularly to a non-motorized treadmill having a composite resistance module.

BACKGROUND OF THE INVENTION

Non-motorized treadmills do not have a motor to save the cost of the motor and save energy, so they have become more and more popular in recent years.

A conventional non-motorized treadmill, as disclosed in U.S. Pat. No. 9,005,085, comprises a closed loop treadmill belt which is wound around front and rear rollers. As shown in FIG. 27 of this patent, the rear roller is provided with a reluctance configuration for providing magnetic resistance.

As disclosed in U.S. Pat. No. 9,233,272 and Taiwan Utility Model Patent No. M530161, a non-motorized treadmill is provided with a magnetic member. The position of the magnetic member can be adjusted. The user can adjust the position of the magnetic member relative to a flywheel for adjusting the rotating resistance of the flywheel.

However, the resistance provided by a single resistance source is limited, and it cannot meet the requirement for a user who needs a high load for training. Especially, when the magnetic resistance is away from the flywheel, the resistance of the treadmill will be too small. As disclosed in Taiwan Utility Model Patent No. M530161, the reluctance control needs to cooperate with the returning of the elastic member. The elastic member may fatigue to affect its durability. Accordingly, the inventor of the present invention has devoted himself based on his many years of practical experiences to solve these problems.

SUMMARY OF THE INVENTION

For a non-motorized treadmill to provide a better load, the primary object of the present invention is to provide a non-motorized treadmill having a composite resistance module. The non-motorized treadmill of the present invention comprises a non-motorized treadmill body and a composite resistance module. The non-motorized treadmill body includes two rollers and a treadmill belt. The treadmill belt is wound around the two rollers. The composite resistance module includes a reluctance module and a fan wheel. The reluctance module includes a wheel body and a resistance member. The wheel body is mounted to one of the rollers. The resistance member is located close to the wheel body. One of the wheel body and the resistance member includes a metal member. The other of the wheel body and the resistance member includes a magnetic member. The fan wheel is connected to one side of the wheel body so that one of the rollers is subjected to magnetic resistance and wind resistance when rotated.

Preferably, the wheel body includes a counterweight disc and an aluminum ring. The aluminum ring is fixedly coupled to the counterweight disc. The aluminum ring serves as the metal member. The resistance member includes a pair of magnetic members. A magnetic space is defined between the pair of magnetic members. The aluminum ring is located in the magnetic space.

Preferably, the fan wheel includes a first seat, a second seat, and a plurality of blades. The first seat is fixedly mounted to the wheel body. The blades are annularly spaced around a rotation center of the wheel body. The blades connect the first seat and the second seat.

Preferably, the non-motorized treadmill body further includes a seat body. The resistance member is movably mounted to the seat body. The composite resistance module further includes an adjusting member. The adjusting member is connected to the resistance member for adjusting the position of the resistance member relative to the wheel body.

Preferably, the resistance member includes an engaging portion and a pivotal portion. The pivotal portion is pivotally connected to the seat body. The adjusting member includes an operating handle and a cable. The operating handle is movably mounted to the seat body. One end of the cable is connected to the operating handle. Another end of the cable is connected to the engaging portion. When the operating handle is operated, the operating handle drives the engaging portion of the resistance member to displace through the cable.

Preferably, the resistance member further includes a contact portion opposite the engaging portion. The contact portion is configured to contact the wheel body for providing a frictional resistance. The adjusting member further includes another cable having two ends connected to the operating handle and the contact portion respectively for the operating handle to drive the contact portion to displace through the other cable.

Preferably, the seat body includes a support frame. The support frame includes a grip portion, a mounting portion, and an upright pole portion. The mounting portion is located between the grip portion and the upright pole portion. The operating handle is movably mounted to the mounting portion. The cables are disposed along the upright pole portion.

Preferably, the mounting portion defines an accommodation space therein. The upright pole portion defines a passage and an opening. The passage is in communication with the accommodation space and the opening. A portion of the operating handle is located in the accommodation space. The cables are located in the passage and extend out of the opening.

Preferably, the mounting portion has a limit groove. At least one portion of the operating handle is located in the limit groove for limiting a displacement stroke of the operating handle.

Preferably, the wheel body is mounted to one end of one of the rollers, and another end of the roller mounted with the wheel body is equipped with a counterweight member.

According to the foregoing technical features, the present invention can achieve the following effects:

1. The resistance source is composite and not limited to a single source to meet the requirement of a larger load.

2. The resistance source employs wind resistance and inductive magnetic reluctance. Compared to a weight load device, the non-motorized treadmill of the present invention is light in weight, and it is easy to carry and move the non-motorized treadmill. The non-motorized treadmill does not consume additional power in use, so that the product is more energy-efficient for use.

3. The metal member adopts the aluminum ring to lower the overall weight of the product.

4. Both ends of the blades of the fan wheel are respectively connected with the first seat and the second seat to provide better structural strength.

5. The position of the resistance member can be adjusted by the adjusting member for adjusting the magnitude of the magnetic resistance, so that the user can adjust the desired magnetic resistance according to his/her needs. When the resistance member is removed from the wheel body, the wind resistance can still be provided by the fan wheel so that the resistance of the treadmill won't be too low.

6. The operating handle of the adjusting member drives the resistance member to displace through the cable, which facilitates the arrangement of the operating handle in the required position.

7. The resistance member can provide frictional resistance, so that the user can quickly brake the treadmill belt according to the needs.

8. The operating handle is installed close to the grip portion, thereby providing a user-friendly operation.

9. The cables may be arranged inside the upright pole portion, thereby preventing the cables from being exposed to affect the overall appearance and reducing the possibility of accidental pulling.

10. When the composite resistance module is mounted to one end of the roller, the other end of the roller may be equipped with a counterweight member to enhance the stability of the running of the roller.

DETAILED DESCRIPTION OF THE PREFERRED EMBODIMENTS

Embodiments of the present invention will now be described, by way of example only, with reference to the accompanying drawings.

Figure 1:
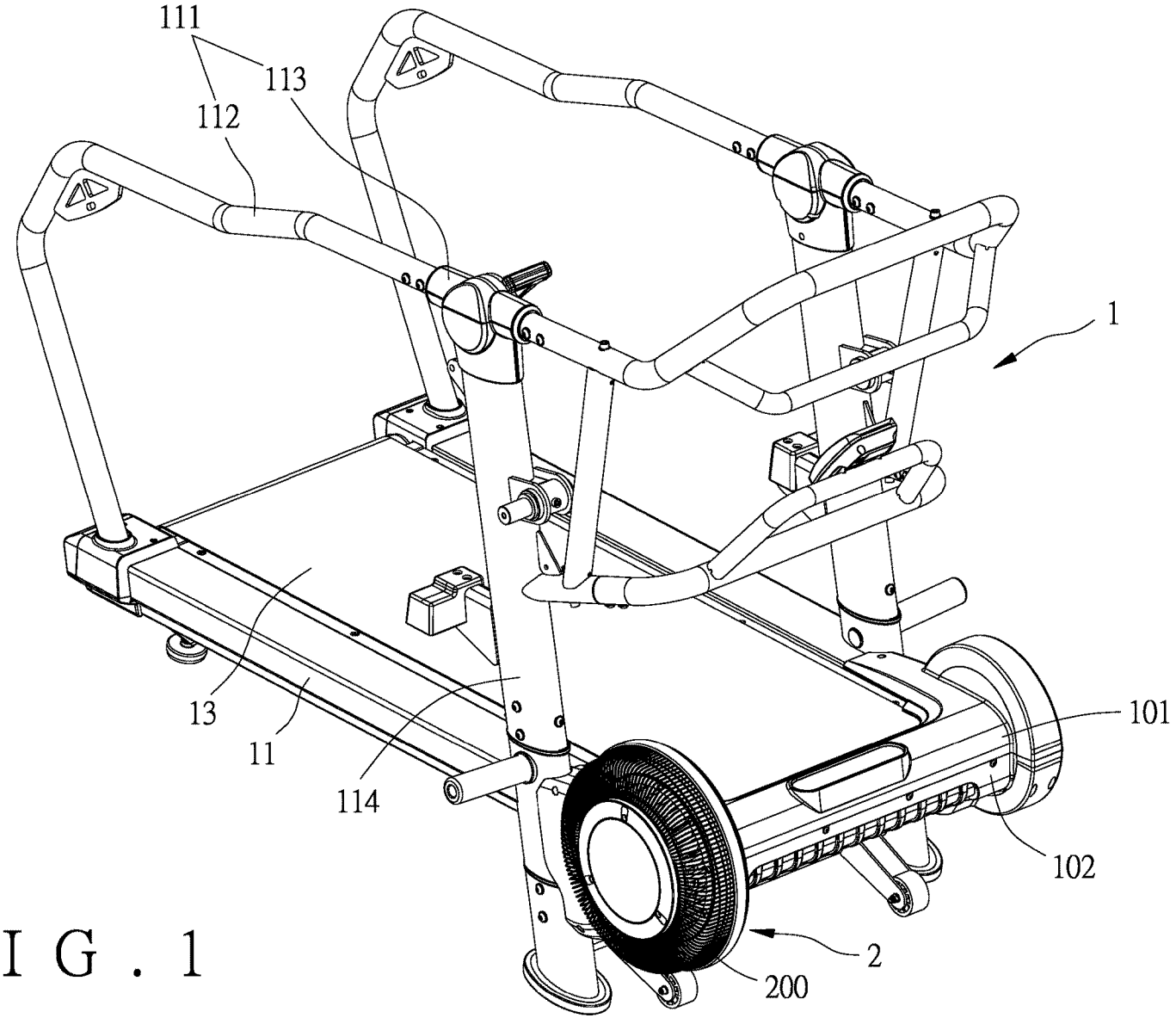
FIG. 1 is a perspective view according to an embodiment of the present invention.
Figure 2:
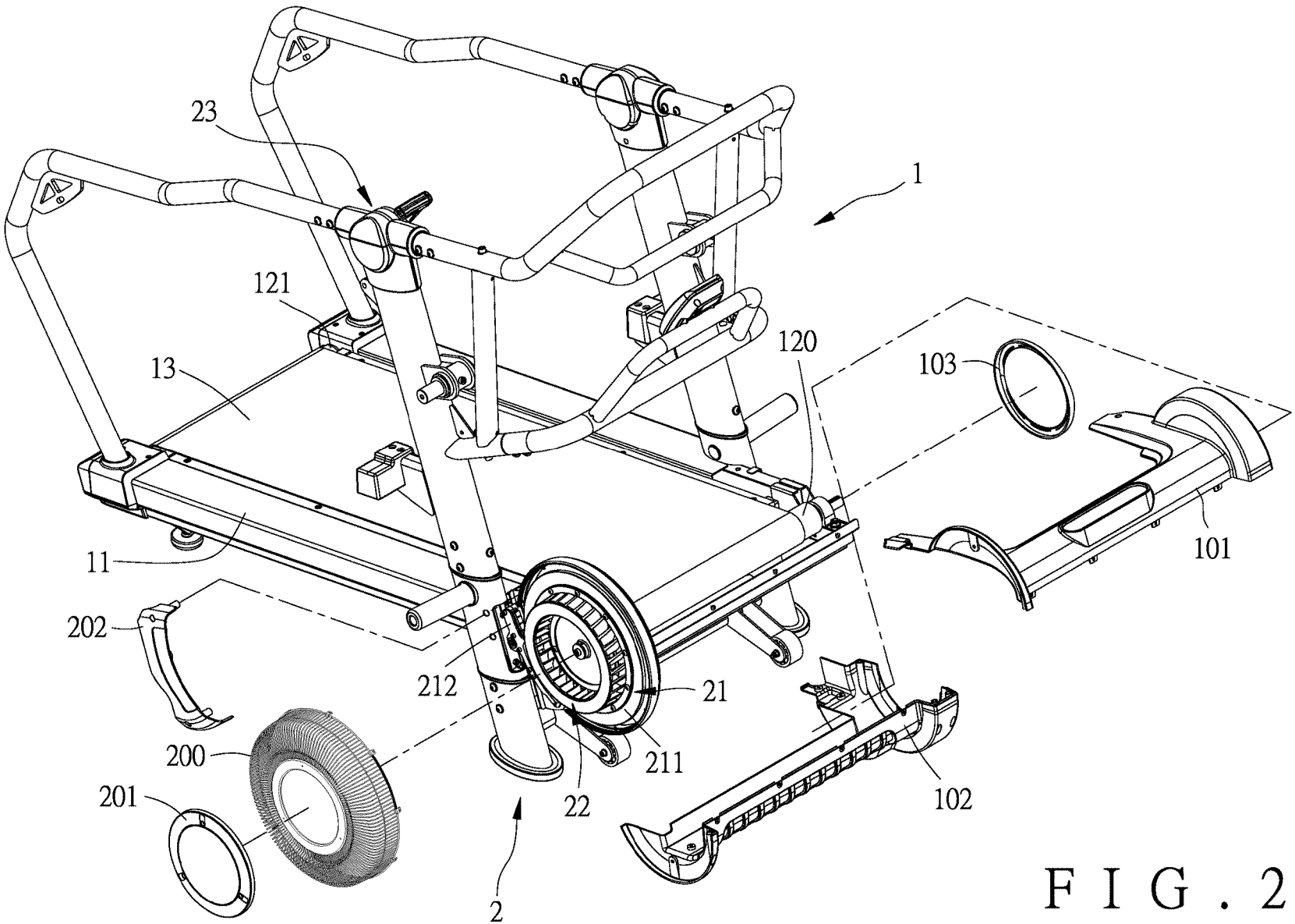
FIG. 2 is an exploded view according to the embodiment of the present invention.

Referring to FIG. 1 and FIG. 2, the present invention discloses a non-motorized treadmill having a composite resistance module. The non-motorized treadmill in accordance with an embodiment of the present invention comprises a non-motorized treadmill body (1) and a composite resistance module (2).

As shown in FIG. 1 and FIG. 2, the non-motorized treadmill body (1) comprises a seat body (11), two rollers (120, 121), and a treadmill belt (13). In this embodiment, the seat body (11) includes a support frame (111). The support frame (111) includes a grip portion (112), a mounting portion (113), and an upright pole portion (114). The mounting portion (113) is located between the grip portion (112) and the upright pole portion (114). The two rollers (120, 121) are opposite to each other and are mounted to the seat body (11). For example, the two rollers (120, 121) are pivotally connected to the seat body (11) and covered with a plurality of casings (101, 102, 103). The treadmill belt (13) is wound around the two rollers (120, 121) to circulate through the two rollers (120, 121) and drives the roller (120) to rotate. When the roller (120) is rotated, the composite resistance module (2) provides magnetic resistance and wind resistance. In this embodiment, there is a height difference between the two rollers (120, 121), so that the treadmill belt (13) is inclined to facilitate running of the treadmill belt (13) when the user runs on the treadmill.

As shown in FIG. 2, the composite resistance module (2) includes a reluctance module (21) and a fan wheel (22), and may be covered with a plurality of covers (200, 201, 202). The cover (200) may be hollow for viewing the internal structure or for providing a certain amount of wind when the fan wheel (22) is running Referring to FIG. 3 in conjunction with FIG. 2, the reluctance module (21) includes a wheel body (211) and a resistance member (212). The wheel body (211) is mounted to one end of the roller (120). The resistance member (212) is located close to the wheel body (211). For example, the resistance member (212) is pivotally connected to a pivot (105) of the seat body (11) or by means of other movable connection. One of the wheel body (211) and the resistance member (212) includes a metal member, and the other of the wheel body (211) and the resistance member (212) includes a magnetic member. Specifically, in this embodiment, the wheel body (211) of the reluctance module (21) includes a counterweight disc (2111) and an aluminum ring (2112). The counterweight disc (2111) may be, for example, an iron disc. The aluminum ring (2112) may be fixedly coupled to the counterweight disc (2111) through a plurality of coupling members (2113). The aluminum ring (2112) serves as the aforesaid metal member to provide a light load. The aluminum ring (2112) may be made of other metal materials (such as copper, zinc, etc.). The resistance member (212) includes a pair of plates (2121) and a plurality of pairs of magnetic members (2122). The magnetic members (2122) are spaced apart from each other in pairs and are disposed on the pair of plates (2121). As shown in FIG. 4, a magnetic space (2123) is defined between the pair of plates (2121) and the pairs of magnetic members (2122). The aluminum ring (2112) is located in the magnetic space (2123) to generate magnetic resistance by the eddy current effect.

Figure 3:
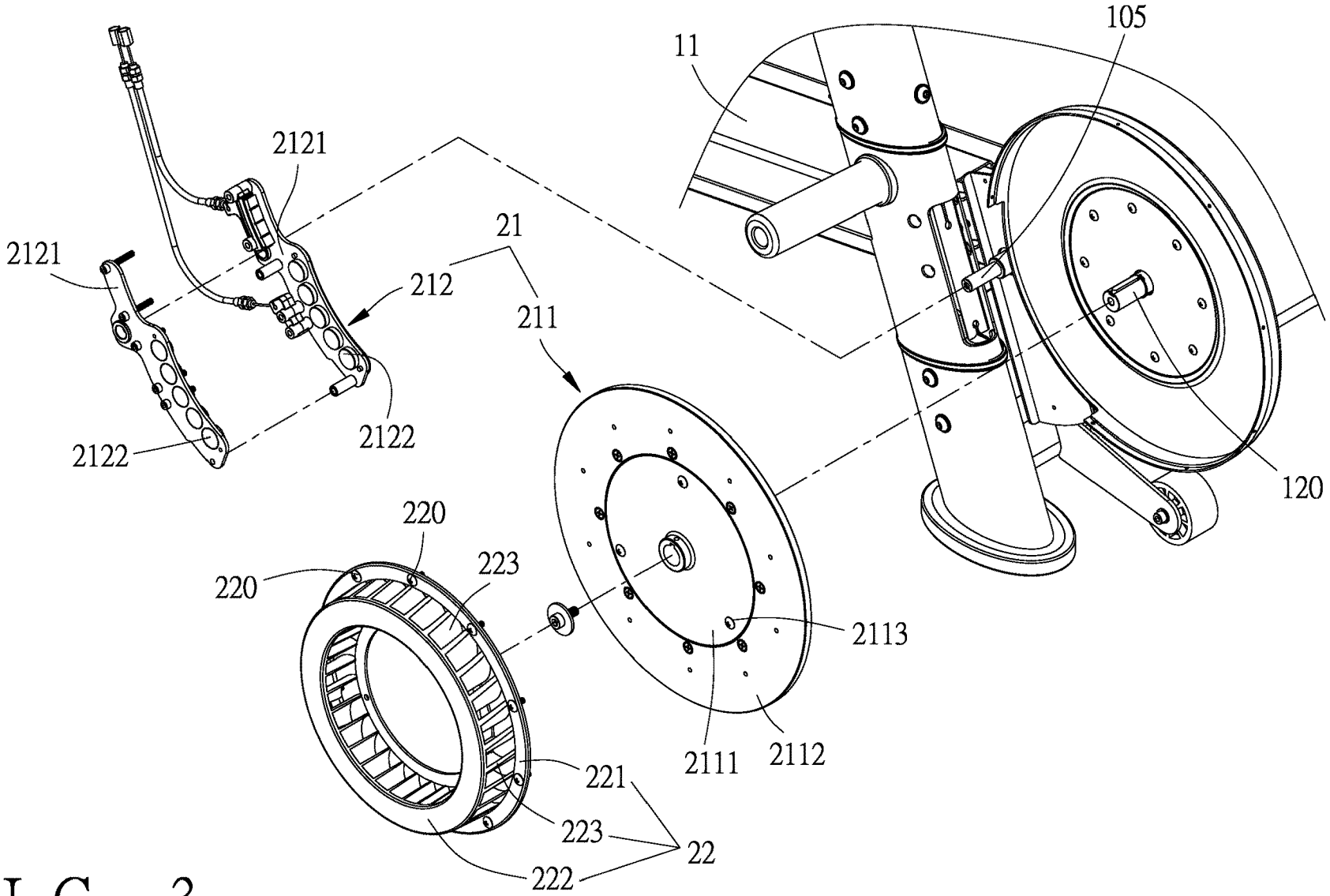
FIG. 3 is a partial exploded view according to the embodiment of the present invention.
Figure 4:
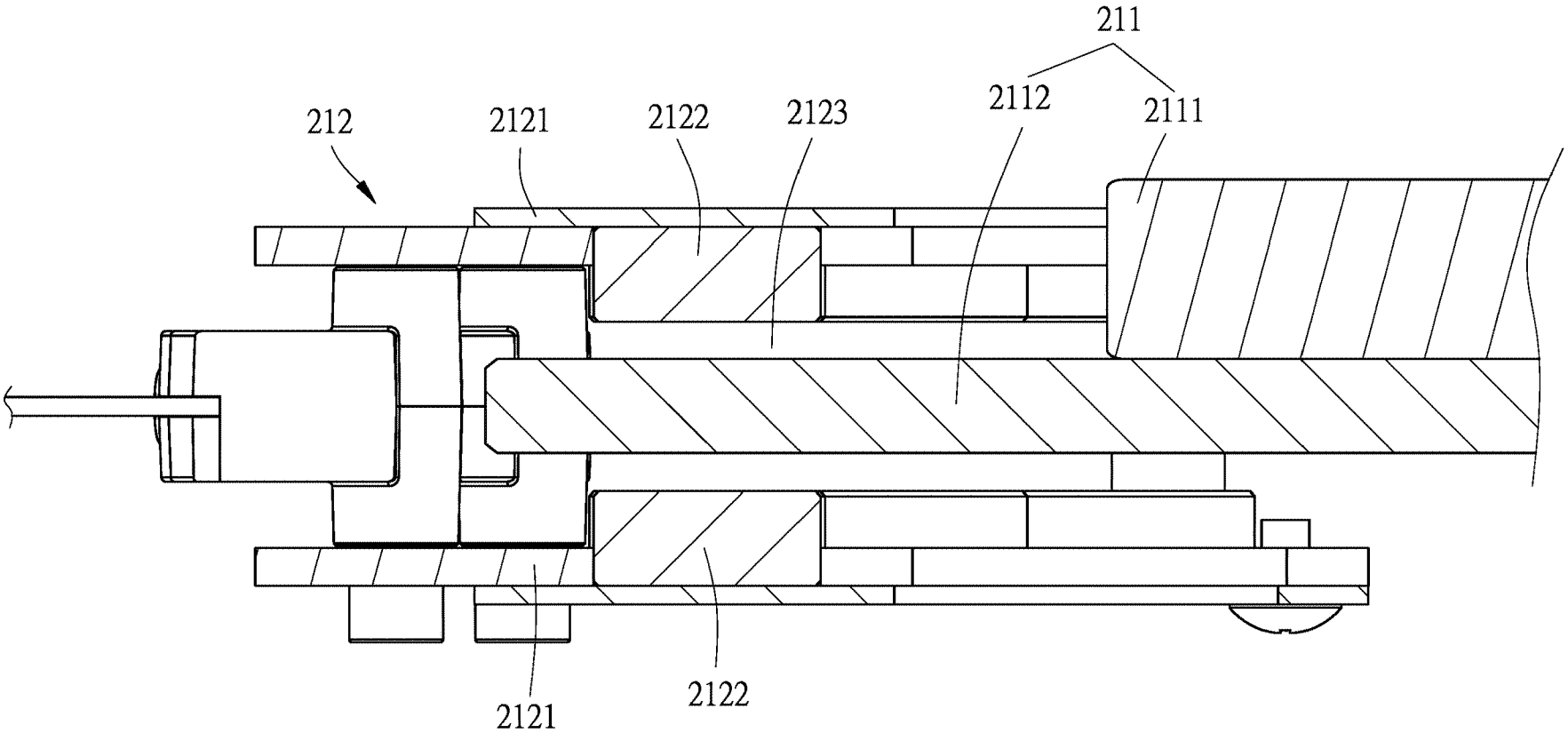
FIG. 4 is a partial sectional view of the reluctance module according to the embodiment of the present invention.
Figure 5:
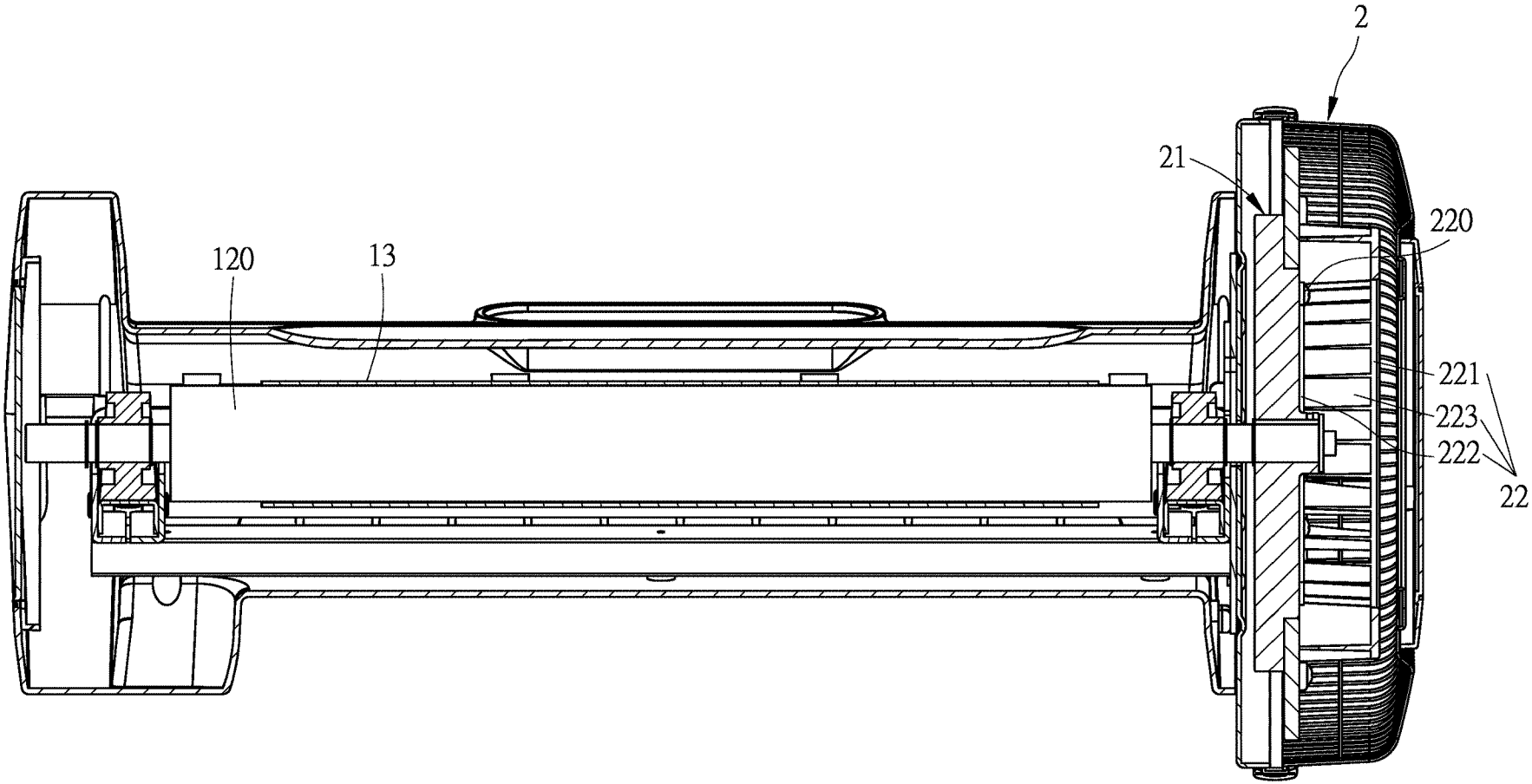
FIG. 5 is a front sectional view according to the embodiment of the present invention.

Referring to FIG. 3 in conjunction with FIG. 5, the fan wheel (22) is connected to the wheel body (211) to rotate along with the wheel body (211). The fan wheel (22) includes a first seat (221), a second seat (222), and a plurality of blades (223). The first seat (221) may be insertedly or fixedly connected to one side of the wheel body (211) through a plurality of coupling members (220). The blades (223) are annularly spaced around a rotation center of the wheel body (211). The blades (223) connect the first seat (221) and the second seat (222), such that the blades (223) have better structural strength.

Figure 6:
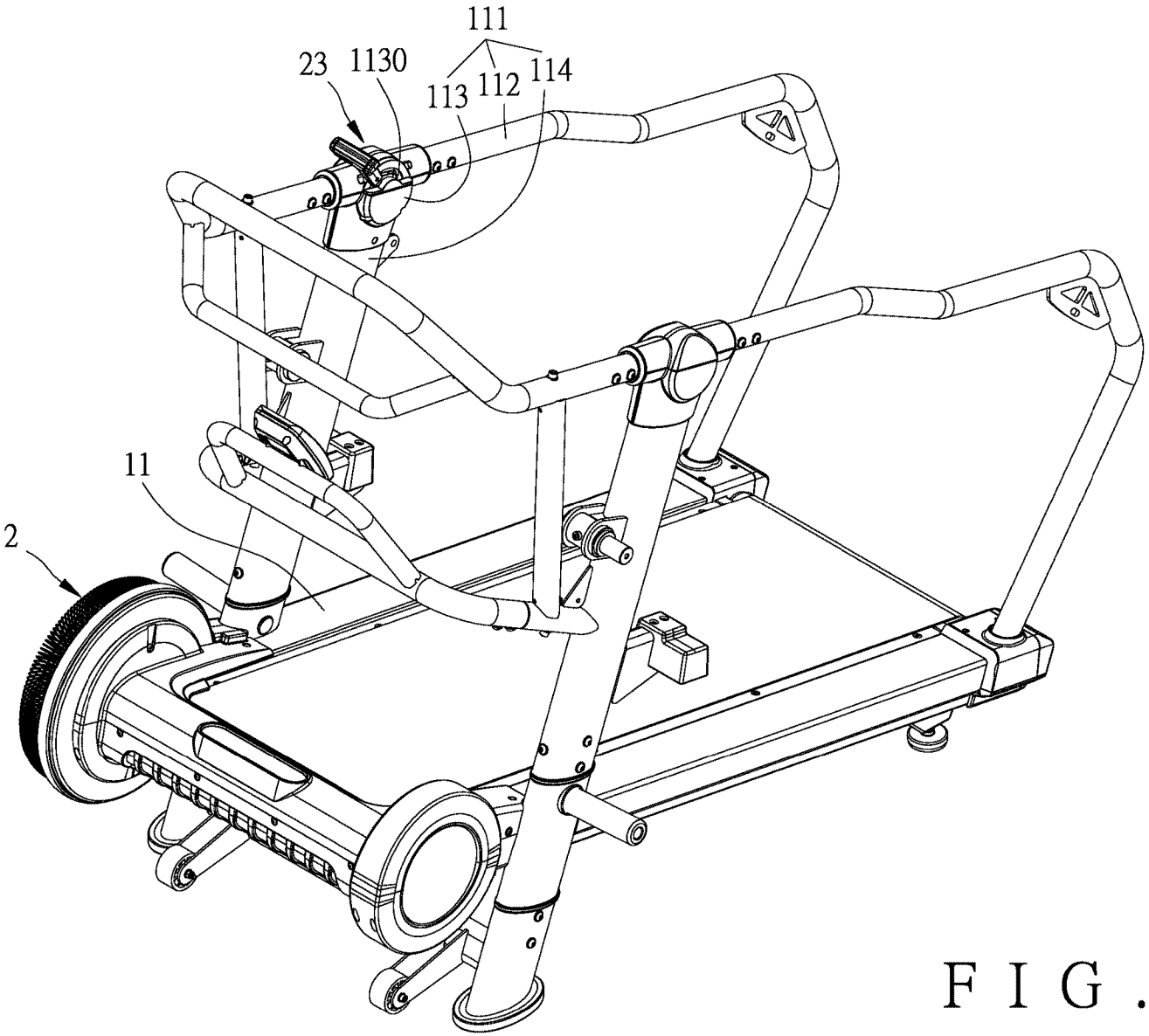
FIG. 6 is another perspective view according to an embodiment of the present invention.
Figure 7:
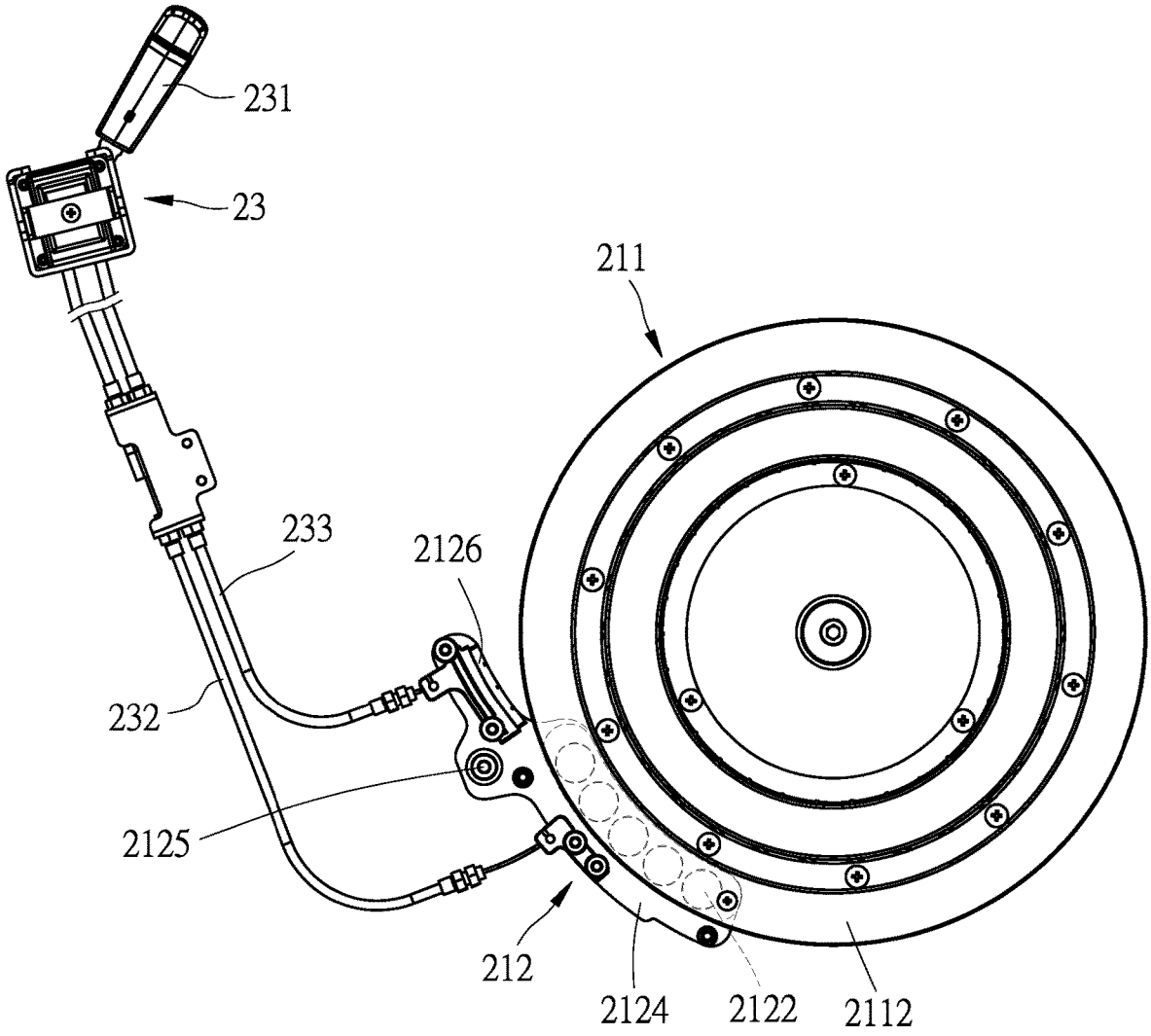
FIG. 7 is a planar view of the reluctance module according to the embodiment of the present invention.
Figure 8:
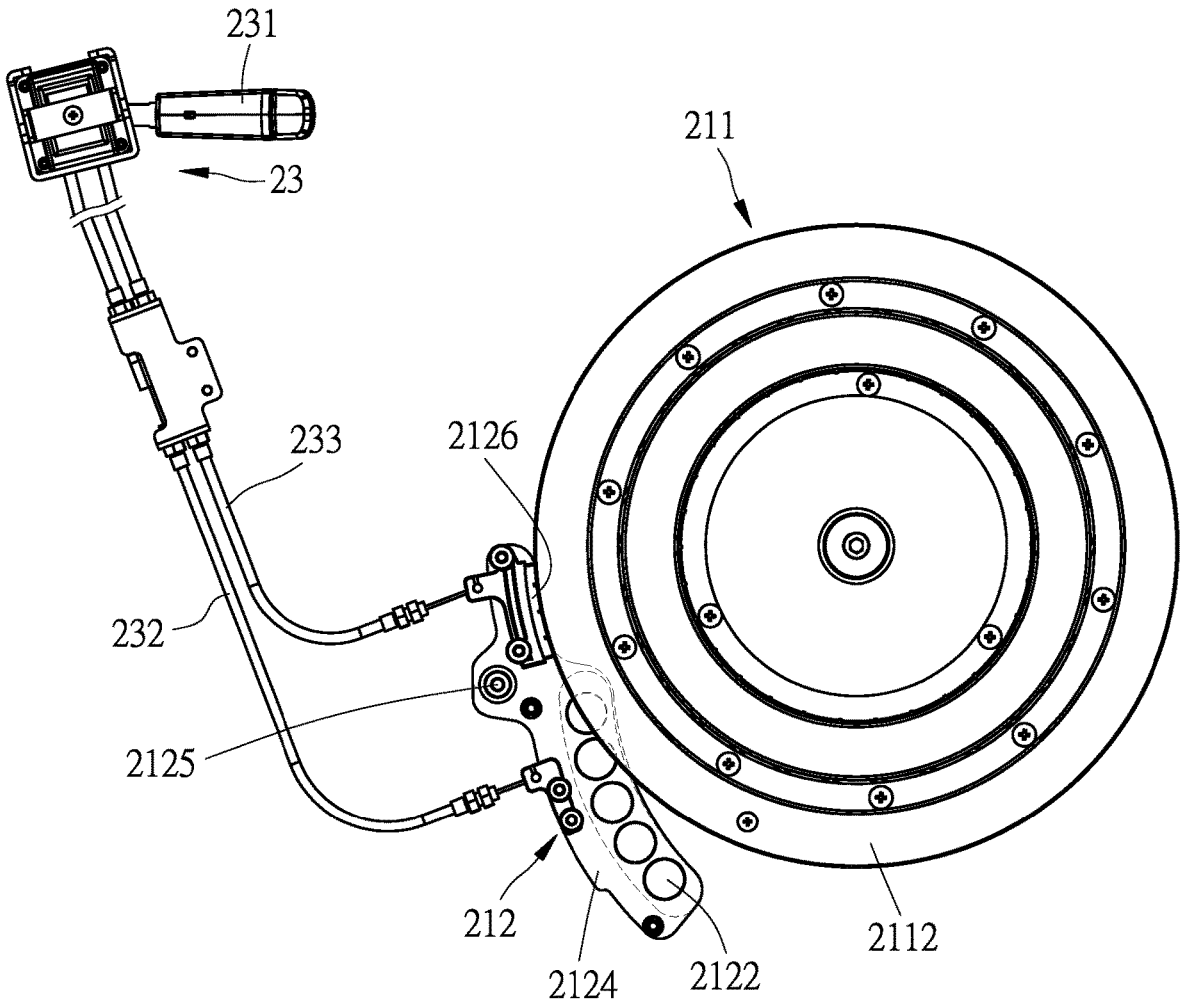
FIG. 8 is a planar view showing the operation of the reluctance module according to the embodiment of the present invention.

Referring to FIG. 6 in conjunction with FIG. 7, preferably, the composite resistance module (2) further includes an adjusting member (23). The adjusting member (23) is connected to the resistance member (212) for adjusting the position of the resistance member (212) relative to the wheel body (211). In this embodiment, the resistance member (212) further includes an engaging portion (2124) and a pivotal portion (2125). The pivotal portion (2125) is pivotally connected to the seat body (11). In addition, the adjusting member (23) includes an operating handle (231) and a plurality of cables (232, 233). The operating handle (231) is movably mounted to the seat body (11). For example, the operating handle (231) is movably mounted to the mounting portion (113) of the seat body (11) close to the grip portion (112), thereby facilitating use and operation. Preferably, the mounting portion (113) has a limit groove (1130). A portion of the operating handle (231) is located in the limit groove (1130) for limiting the displacement stroke of the operating handle (231). The cables (232, 233) each have one end connected to the operating handle (231) and another end connected to the resistance member (212) wherein the other end of the cable (232) is connected to the engaging portion (2124) of the resistance member (212). Referring to FIG. 7 and FIG. 8, when the operating handle (231) is operated, the operating handle (231) drives the engaging portion (2124) of the resistance member (212) to displace through the cable (232) for controlling the magnetic member (2122) of the resisting member (212) to be partially or fully away from the aluminum ring (2112) of the wheel body (211) to adjust the magnitude of the magnetic resistance acting on the aluminum ring (2112) due to the eddy current effect. In this embodiment, the resistance member (212) further includes a contact portion (2126) opposite the engaging portion (2124). The contact portion (2126) is configured to contact the wheel body (211) for providing a frictional resistance so that the user can quickly stop the wheel body (211). In this embodiment, the operating handle (231) is connected with the contact portion (2126) via another cable (233) for displacing the contact portion (2126) of the resistance member (212).

Figure 9:
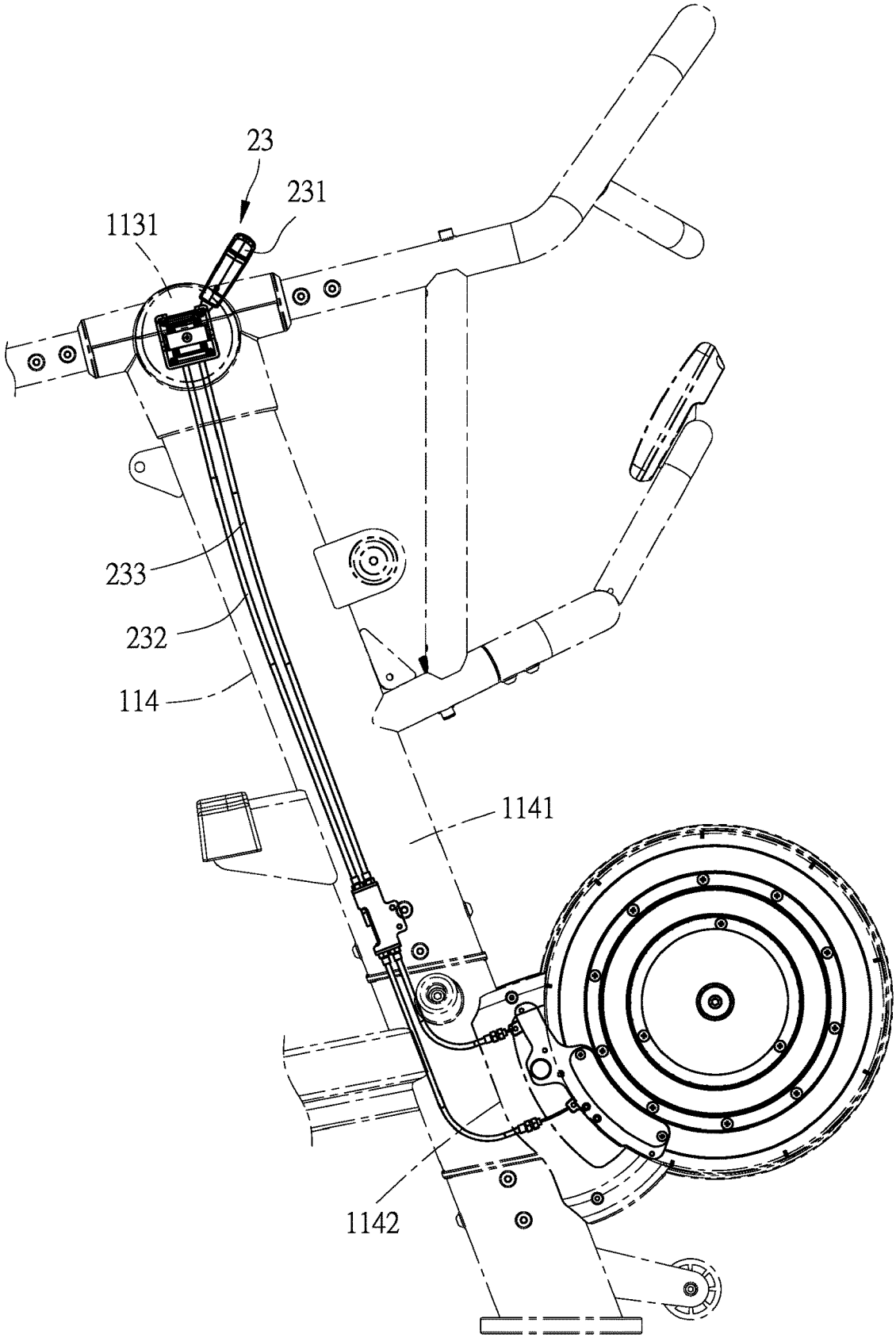
FIG. 9 is a planar view showing the reluctance module integrated with the seat body according to the embodiment of the present invention.

FIG. 9 illustrates a suitable arrangement of the adjusting member (23). The cables (232, 233) are disposed along the upright pole portion (114). The mounting portion (113) defines an accommodation space (1131) therein. The upright pole portion (114) defines a passage (1141) and an opening (1142). The passage (1141) is in communication with the accommodation space (1131) and the opening (1142). A portion of the operating handle (231) is located in the accommodation space (1131). The cables (232, 233) are located in the passage (1141) and extend out of the opening (1142), thereby preventing the cables (232, 233) from being exposed to affect the overall appearance and reducing the possibility of accidental pulling.

Figure 10:
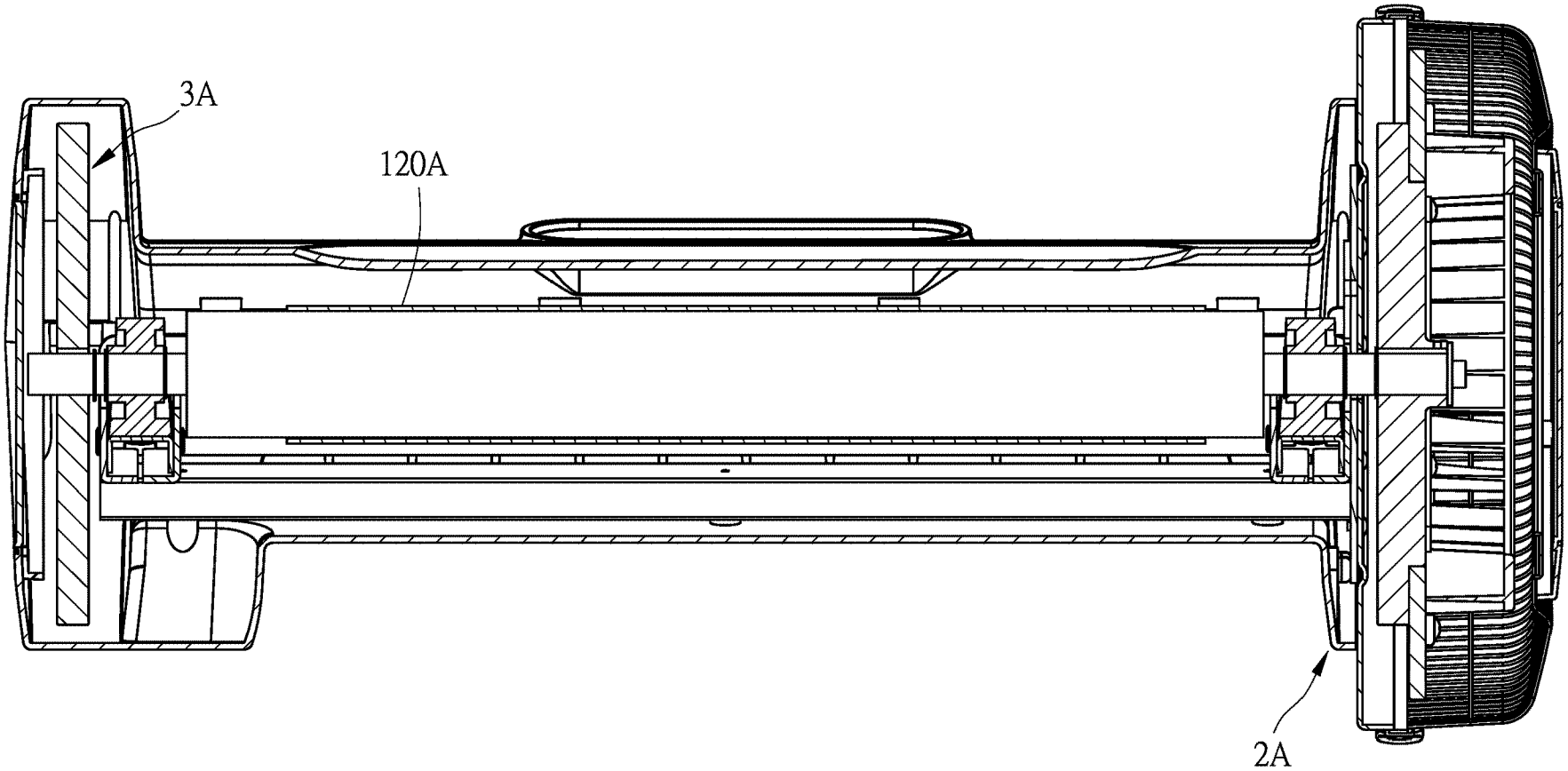
FIG. 10 is a sectional view according to another embodiment of the present invention.

In addition, FIG. 10 shows another embodiment of the present invention. As shown in FIG. 10, the composite resistance module (2A) is mounted to one end of a roller (120A) as in the aforesaid embodiment. The main difference is that the other end of the roller (120A) may be equipped with a counterweight member (3A). The counterweight member (3A) may be another fan wheel or a common load member, such that the running of the roller (120A) is relatively stable.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A non-motorized treadmill, comprising:

a non-motorized treadmill body, wherein the non-motorized treadmill body includes a seat body, two rollers, and a treadmill belt, the treadmill belt being wound around the two rollers; and a composite resistance module, wherein the composite resistance module includes a reluctance module, an adjusting member, and a fan wheel, wherein the reluctance module includes a wheel body and a resistance member, the wheel body being mounted to one of the two rollers, the resistance member being located adjacent the wheel body and being movably mounted to the seat body;

wherein the adjusting member is connected to the resistance member for adjusting a position of the resistance member relative to the wheel body;

wherein one of the wheel body and the resistance member includes a metal member, and an other of the wheel body and the resistance member includes a magnetic member;

wherein the fan wheel is connected to a side of the wheel body, such that the one of the two rollers is thereby subjected to both magnetic resistance and wind resistance when rotated;

wherein the resistance member includes an engaging portion, a pivotal portion, and a contact portion opposite the engaging portion;

wherein the pivotal portion is pivotally connected to the seat body;

wherein the adjusting member includes an operating handle and a first cable, wherein the operating handle is movably mounted to the seat body, a first end of the first cable is connected to the operating handle, and a second end of the first cable is connected to the engaging portion of the resistance member, wherein the operating handle is operated to drive the engaging portion of the resistance member to displace through the first cable;

wherein the adjusting member further includes a second cable, a first end of the second cable is connected to the operating handle and a second end of the second cable is connected to the contact portion of the resistance member, wherein the operating handle is operated to drive the contact portion of the resistance member to displace through the second cable, and wherein the contact portion of the resistance member is configured to contact the wheel body for providing frictional resistance.

2. The non-motorized treadmill as claimed in claim 1, wherein the wheel body includes a counterweight disc and an aluminum ring, the aluminum ring is fixedly coupled to the counterweight disc, the aluminum ring being the metal member;

wherein the resistance member further includes a pair of magnetic members, a magnetic space is defined between the pair of magnetic members, and the aluminum ring is disposed in the magnetic space.

3. The non-motorized treadmill as claimed in claim 1, wherein the fan wheel includes a first seat, a second seat, and a plurality of blades, the first seat is fixedly mounted to the wheel body, the plurality of blades are annularly spaced about a rotation center of the wheel body, and the plurality of blades connect the first seat and the second seat one to another.

4. The non-motorized treadmill as claimed in claim 1, wherein the seat body includes a support frame, the support frame includes a grip portion, a mounting portion, and an upright pole portion, the mounting portion is located between the grip portion and the upright pole portion, the operating handle is movably mounted to the mounting portion, and the first cable is disposed along the upright pole portion.

5. The non-motorized treadmill as claimed in claim 4, wherein the mounting portion defines an accommodation space therein, the upright pole portion defines a passage and an opening, the passage is in communication with the accommodation space and the opening;

wherein at least a portion of the operating handle is disposed in the accommodation space, and the first cable is located in the passage and extends out of the opening.

6. The non-motorized treadmill as claimed in claim 5, wherein the mounting portion has a limit groove, and at least a portion of the operating handle is disposed in the limit groove for limiting a displacement stroke of the operating handle.

7. The non-motorized treadmill as claimed in claim 1, wherein the wheel body is mounted to one end of the one of the rollers, and another end of the one of the rollers mounted with the wheel body is equipped with a counterweight member.

* * * * *